US005125354A

United States Patent [19]

Hayashi et al.

[11] Patent Number: 5,125,354

[45] Date of Patent: Jun. 30, 1992

[54] SEWING MACHINE WITH A BUILT-IN DRIVING MOTOR

[75] Inventors: Toshio Hayashi, Inuyama; Tsutomu Makihara, Nagoya, both of Japan

[73] Assignee: Brother Kogyo Kabushiki Kaisha, Nagoya, Japan

[21] Appl. No.: 698,261

[22] Filed: May 10, 1991

[30] Foreign Application Priority Data

Jul. 9, 1990 [JP] Japan ..... 2-181934

[51] Int. Cl.[5] ..... D05B 69/02

[52] U.S. Cl. ..... 112/259; 112/220

[58] Field of Search ..... 112/259, 220, 221, 84; 310/51, 90, 89, 75 D, 67 R, 75 R, 80; 277/53, 57; 464/178; 384/510, 537

[56] References Cited

U.S. PATENT DOCUMENTS 3,821,937 7/1974 Seesselberg ..... 112/220 X 3,832,613 8/1974 Bernstein et al. ..... 318/269

4,955,462 9/1990 Bilodeau et al. ..... 277/57 X

FOREIGN PATENT DOCUMENTS 1-21996 4/1989 Japan .

*Primary Examiner*—Werner H. Schroeder

*Assistant Examiner*—Paul C. Lewis

*Attorney, Agent, or Firm*—Oliff & Berridge

[57] ABSTRACT

A motor for driving a sewing machine is mounted in a machine frame of the sewing machine. A motor shaft of the motor is coaxially connected to a main shaft of the sewing machine by means of a coupling. The motor shaft is supported in a housing of the motor by means of a bearing provided on one side of the motor. On the other side of the motor, the coupling joining the motor shaft and the main shaft is supported by a bearing mounted in a frame arm of the sewing machine.

14 Claims, 5 Drawing Sheets

SEWING MACHINE WITH A BUILT-IN DRIVING MOTOR

BACKGROUND OF THE INVENTION

1. Field of the invention

The present invention relates to a mounting structure for a sewing machine motor built into a machine frame of a sewing machine.

2. Description of Related Art

U.S. Pat. No. 3,832,613 and Japanese Patent Publication No. 1-21996 disclose a sewing machine wherein a main shaft is rotatably supported in a machine frame and a motor for driving the sewing machine is mounted in the machine frame in an opposed relationship to an end of the main shaft. In such a sewing machine, the motor shaft of the motor is connected to the main shaft by means of a coupling.

However, in such a sewing machine it is necessary to have concentricity and straightness between the main shaft and the motor shaft. If the concentricity and the straightness are insufficient, there is a possibility that a stress will be applied to the bearings for the main shaft and the motor shaft or the coupling between both the shafts, causing breakage of the bearings or the coupling, seizure of the main shaft and the motor shaft, or increase in load torque.

Accordingly, it is necessary to increase the mounting accuracy of the main shaft with respect to the machine frame, the mounting accuracy of the motor with respect to the machine frame, and the mounting accuracy of the motor shaft with respect to the housing of the motor. To attain these increased mounting accuracies, highly sophisticated manufacturing techniques are required which, in turn, cause an increase in manufacturing costs.

SUMMARY OF THE PRESENT INVENTION

It is an object of the present invention to provide a sewing machine which provides the requisite concentricity and straightness between the main shaft and the motor shaft.

It is another object of the present invention to provide a sewing machine which eliminates the necessity for increasing the mounting accuracy of the main shaft with respect to the machine frame, the mounting accuracy of the motor with respect to the machine frame, and the mounting accuracy of the motor shaft with respect to the housing of the motor to provide the requisite concentricity and the straightness between the main shaft and the motor shaft.

It is a further object of the present invention to provide a sewing machine which eliminates the necessity for highly sophisticated techniques to reduce manufacturing costs and yet ensure the requisite concentricity and straightness between the main shaft and the motor shaft.

It is a still further object of the present invention to provide a sewing machine which can reliably prevent breakage of the bearings and the coupling, seizure of the main shaft and the motor shaft, or an increase in a load torque during the operation of the sewing machine.

According to the present invention, to achieve the above objects there is provided a sewing machine comprising a machine frame; a main shaft rotatably mounted in the machine frame; a motor provided in the machine frame in an opposed relationship to an end of the main shaft for driving the sewing machine, the motor having a motor shaft and a housing; a coupling for coaxially connecting the main shaft with the motor shaft; and a bearing provided on an opposite side of the motor with respect to the coupling for supporting the motor shaft in the housing.

In the sewing machine as described above, when the motor is mounted in the machine frame and the motor shaft is connected to the main shaft by the coupling, the motor shaft is supported in the housing of the motor by the bearing on the opposite side of the motor with respect to the coupling.

With this mounting structure of the motor, a length of the motor shaft between a bearing on the same side of the motor as the coupling and the bearing on the opposite side of the motor than the coupling is large. Accordingly, in connecting the motor shaft through the coupling to the main shaft, the motor shaft is allowed to readily move about the bearing on the opposite side of the motor with respect to the coupling, thereby absorbing any assembly error between the main shaft and the motor shaft. Therefore, it is unnecessary to increase the mounting accuracy of the main shaft with respect to the machine frame, the mounting accuracy of the motor with respect to the machine frame, and the mounting accuracy of the motor shaft with respect to the housing of the motor.

Accordingly, the concentricity and the straightness between the main shaft and the motor shaft can be easily ensured without the necessity of a highly sophisticated manufacturing techniques.

Further, it is possible to reliably prevent the breakage of the bearings and the coupling, the seizure of the main shaft and the motor shaft, or an increase in load torque during the operation of the sewing machine.

BRIEF DESCRIPTION OF THE DRAWINGS

The present invention will be described in detail with reference to the following figures wherein.

DETAILED DESCRIPTION OF THE PREFERRED EMBODIMENTS

There will now be described a preferred embodiment of the sewing machine with a built-in driving motor, according to the invention, with reference to the drawings.

Figure 2:
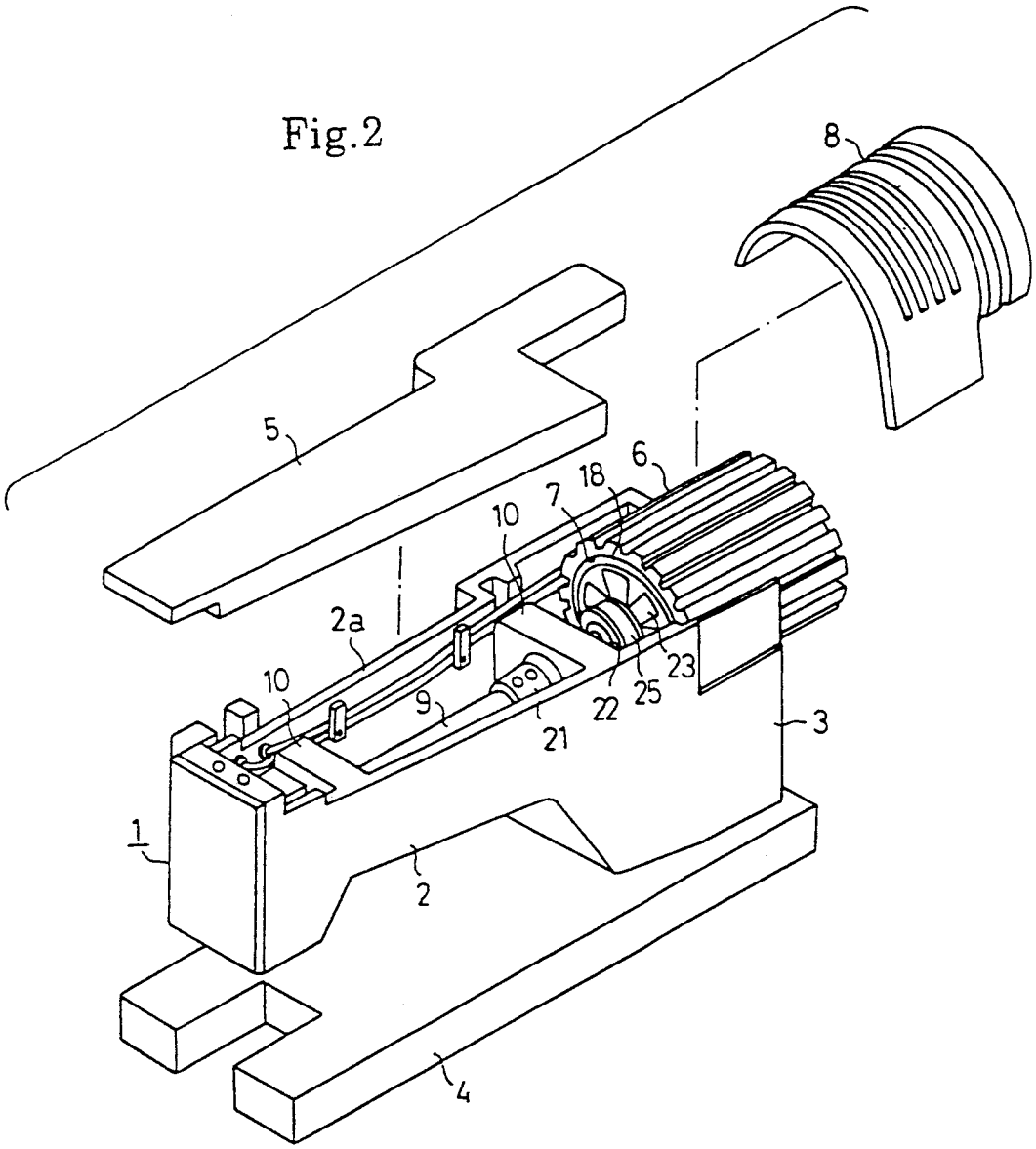
FIG. 2 is an exploded perspective view of the sewing machine.
Figure 3:
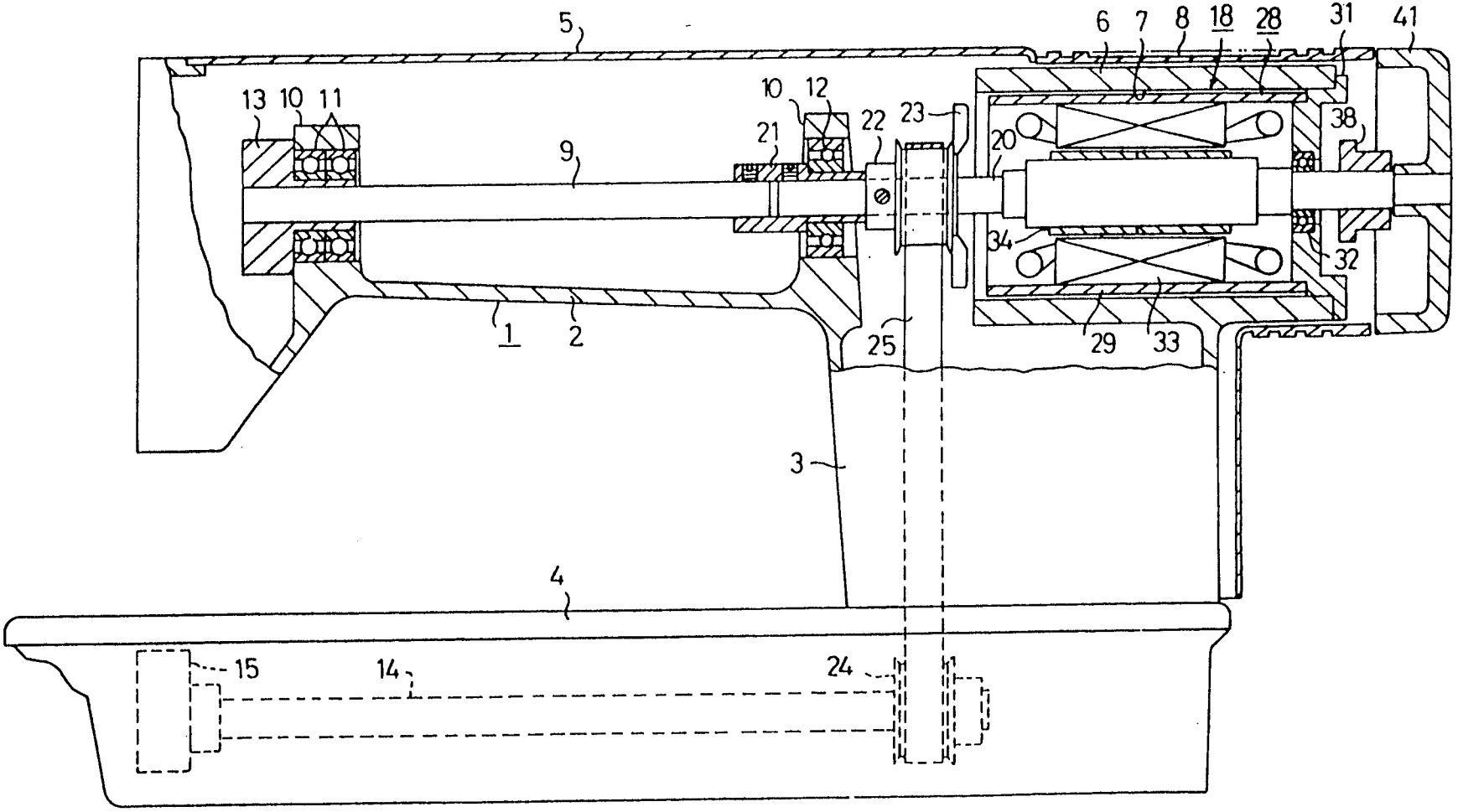
FIG. 3 is a front elevational view of the sewing machine in partial vertical cross section.

Referring to FIGS. 2 and 3, a machine frame 1 comprises an arm 2, a standard 3 and a bed 4. A cover 5 is detachably mounted on an upper opening portion 2*a* of the arm 2. The standard 3 is formed at its upper portion with a cylindrical portion 6. The cylindrical portion 6 is formed with an axial bore 7 opened at opposite axial ends of the cylindrical portion 6. A cover 8 is mounted so as to cover an outer surface of the cylindrical portion 6.

An upper shaft 9, or main shaft of the sewing machine, is rotatably supported by ball bearings 11 and 12 in two supporting walls 10 formed in the arm 2. A needle bar crank 13 is fixedly engaged with the end portion of the upper shaft 9 away from the motor. A part of the needle bar crank 13 extends between the upper shaft 9 and an inner race of the ball bearing 11. When the upper shaft 9 is rotated, a needle (not shown) is driven through the needle bar crank 13. A lower shaft 14 is rotatably supported in the bed 4. A loop taker 15 is mounted on an end portion of the lower shaft 14 (the left end as shown in FIG. 3).

Figure 1:
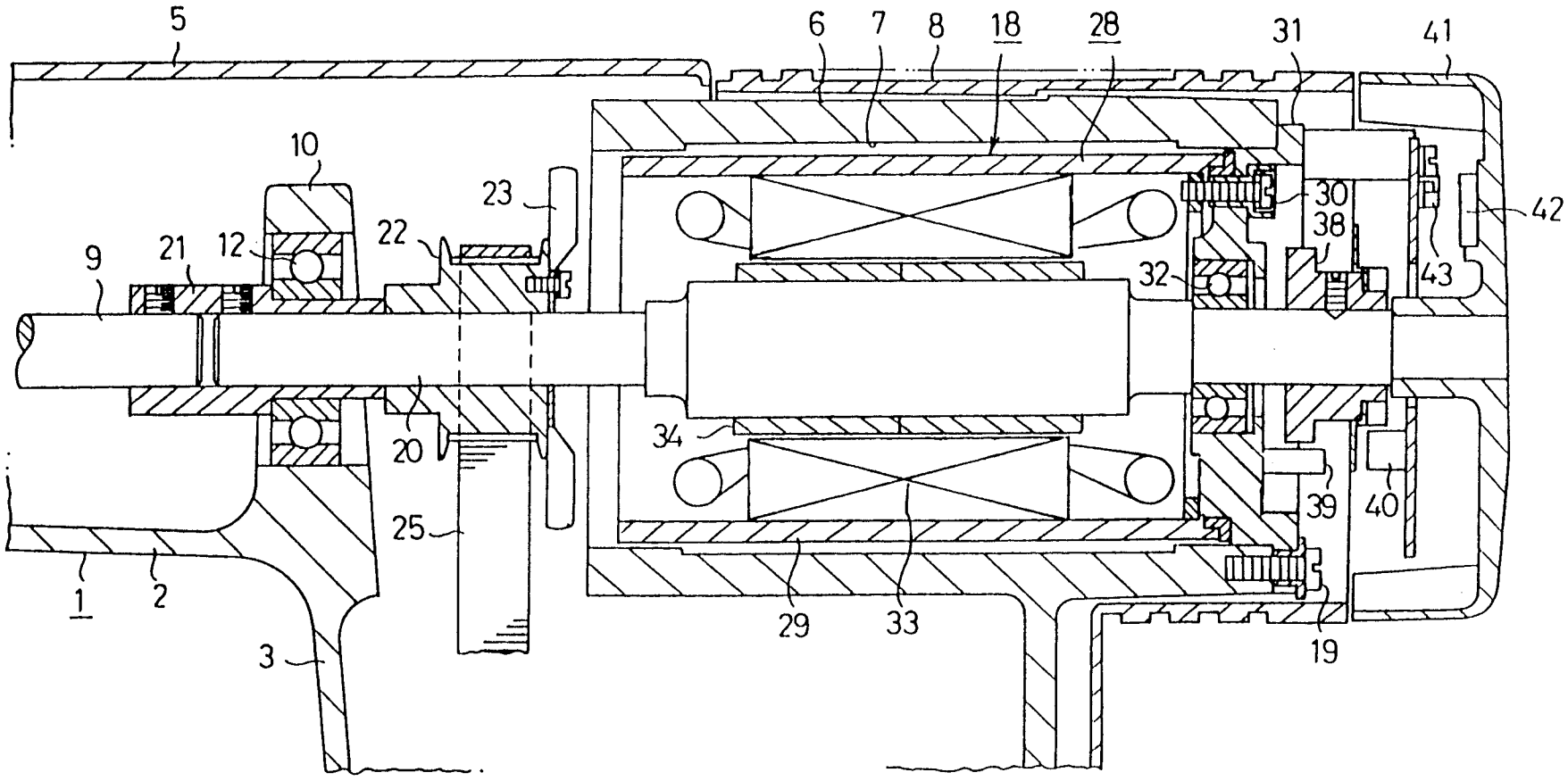
FIG. 1 is a vertical sectional view of an essential part of the sewing machine according to a first preferred embodiment of the invention.

Referring to FIGS. 1 and 3, a motor 18 for driving the sewing machine is seated in the axial bore 7 of the cylindrical portion 6 from a right end thereof, and is fixed to the cylindrical portion 6 by means of a screw 19. A motor shaft 20 of the motor 18 projects from both ends of the cylindrical portion 6. A coupling 21 is provided between the motor shaft 20 and the upper shaft 9 so as to connect a left end portion (as portrayed in FIGS. 1 and 3) of the motor shaft 20 with a right end portion of the upper shaft 9. A part of the coupling 21 extends between the motor shaft 20 and an inner race of the ball bearing 12.

A driving timing pulley 22 is fixedly engaged with the motor shaft 20 at a position adjacent to the coupling 21. A fan 23 for cooling the motor 18 is mounted on a right end surface of the driving timing pulley 22. A driven timing pulley 24 is fixedly engaged at the opposite end of the lower shaft 14 from the loop taker 15. A timing belt 25 is wrapped between the driving timing pulley 22 and the driven timing pulley 24. Thus, rotation of the motor shaft 20 is transmitted through the driving timing pulley 22, the timing belt 25 and the driven timing pulley 24 to the lower shaft 14 to thereby drive the loop taker 15.

As shown in FIG. 1, the motor 18 is provided with a housing 28 consisting of a cylindrical outer shell 29 and a bracket 31 mounted to a right end of the outer shell 29 by means of a screw 30. The motor shaft 20 of the motor 18 is rotatably supported by a ball bearing 32 in the bracket 31 of the housing 28. A stator 33 of the motor 18 is mounted on an inner surface of the outer shell 29 of the housing 28 and a rotor 34 of the motor 18 is mounted on the motor shaft 20 in opposed relationship to the stator 33.

As mentioned above, the bracket 31 is provided on the right side of the housing 28 (as shown in FIGS. 1 and 3) of the motor 18, and the motor shaft 20 is supported through the ball bearing 32 in the bracket 31 of the housing 28 on the right side only, whereas on the left side of the motor 18 the motor shaft 20 is connected to the upper shaft 9. Accordingly, a length of the motor shaft 20 between the ball bearings 12 and 32 is larger with the upper shaft 9 and the motor shaft 20 connected to each other by the coupling 21 than is the case in conventional sewing machines where the motor shaft is supported on both sides of the motor by a bearing. Therefore, in connecting the motor shaft 20 to the upper shaft 9, the motor shaft 20 is allowed to readily move about the ball bearing 32 as it is only directly supported by bearing 32 during assembly. Accordingly, minor alignment errors between the upper shaft 9 and the motor shaft 20 can be absorbed by flexion of the motor shaft to compensate for the minor lack of concentricity and straightness between the upper shaft 9 and the motor shaft 20.

A magnetic drum 38 is fixedly engaged with a right end portion of the motor shaft 20, as seen in FIG. 1, of the motor 18. A rotation sensor 39 and a pole sensor 40 are provided on the bracket 31 of the motor 18 in opposed relationship to the magnetic drum 38. A pulley 41 is mounted on the right end portion of the motor shaft 20 to the right of the magnetic drum 38. A permanent magnet 42 is mounted on an inner surface of the pulley 41, and a needle position sensor 43 is mounted on the bracket 31 to face the permanent magnet 42 on the pulley 41.

The operation of the preferred embodiment mentioned above will now be described.

When the mounting accuracy of the upper shaft 9 with respect to the arm 2 of the machine frame 1, the mounting accuracy of the motor 18 with respect to the axial bore 7 of the machine frame or the mounting accuracy of the motor shaft 20 with respect to the housing 28 of the motor 18 is deficient, misalignment between the upper shaft 9 and the motor shaft 20 occurs and creates problems in connecting the upper shaft 9 and the motor shaft 20 by means of a coupling 21. However, in the sewing machine of the preferred embodiment, the motor shaft 20 of the motor 18 is supported at one end by the ball bearing 32 in the bracket 31 of the housing 28. That is, the motor shaft 20 (as shown in FIGS. 1 and 3) is only supported on the right side of the motor 18, the motor shaft 20 is connected to the upper shaft 9 at its left end. Furthermore, when the motor 18 is mounted into the axial bore 7 of the machine frame 1, and the motor shaft 20 is connected to the upper shaft 9 by means of the coupling 21, the left end portion of the motor shaft 20 and the connection to the upper shaft 9 is supported by the ball bearing 12 in the arm 2 of the machine frame 1.

As a result, the length of the motor shaft 20 between the left ball bearing !2 and the right ball bearing 32 is large. Thus, even if the mounting accuracy of the upper shaft 9 with respect to the machine frame 1, the mounting accuracy of the motor 18 with respect to the machine frame or the mounting accuracy of the motor shaft 20 with respect to the housing 28 of the motor 18 is deficient, the motor shaft 20 is able to readily pivot at the bearing 32 during the connection of the motor shaft 20 to the upper shaft 9 by means of the coupling 21, thereby absorbing any assembly error between the upper shaft 9 and the motor shaft 20. During operation, the motor shaft 20 flexes to compensate for any minor misalignment.

Accordingly, it is not necessary to use highly sophisticated manufacturing techniques for increasing the mounting accuracy of the upper shaft 9 with respect to the machine frame 1, the mounting accuracy of the motor 18 with respect to the machine frame and the mounting accuracy of the motor shaft 20 with respect to the housing 28 of the motor 18. That is, a minor lack of concentricity and straightness between the upper shaft 9 and the motor shaft 20 can be easily compensated for by the invention. Furthermore, as the minor deficiencies, concentricity and straightness between the upper shaft 9 and the motor shaft 20 are compensated for, there is no possibility that stress is applied to the ball bearings 11, 12 and 32, supporting the upper shaft 9 and the motor shaft 20, and the coupling 21, connecting the upper shaft 9 with the motor shaft 20, during the operation of the sewing machine to cause breakage of the ball bearings 11, 12 and 32 and the coupling 21. Therefore, it is possible to reliably prevent the upper shaft 9 and the motor shaft 20 from seizing or suffering a load torque increase.

Next, some alternative embodiments of the invention will be described with reference to FIGS. 4 to 7.

Figure 4:
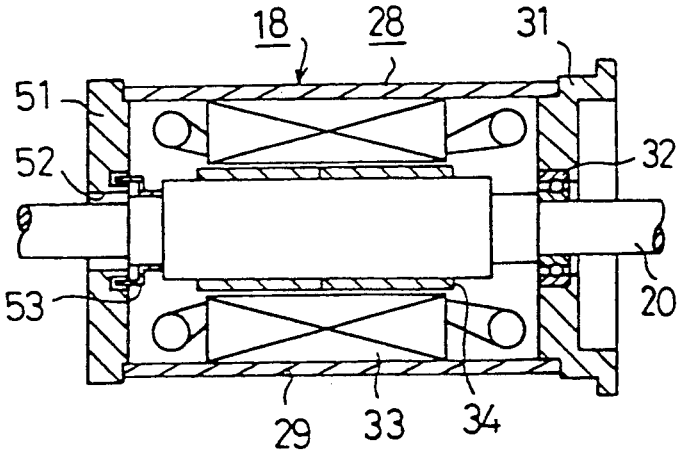
FIG. 4 is a sectional view of the motor according to a second preferred embodiment of the invention.

FIG. 4 shows a second embodiment of the invention. In this embodiment, another bracket 51 is mounted to the left end of the housing 28 of the motor 18. The bracket 51 is formed with a large-diameter through-hole 52. The motor shaft 20 passes through the through-hole 52. A labyrinth packing 53 is provided between the inner opening edge of the through-hole 52 and the motor shaft 20 to prevent the intrusion of lubricating oil into the housing 28.

Figure 5:
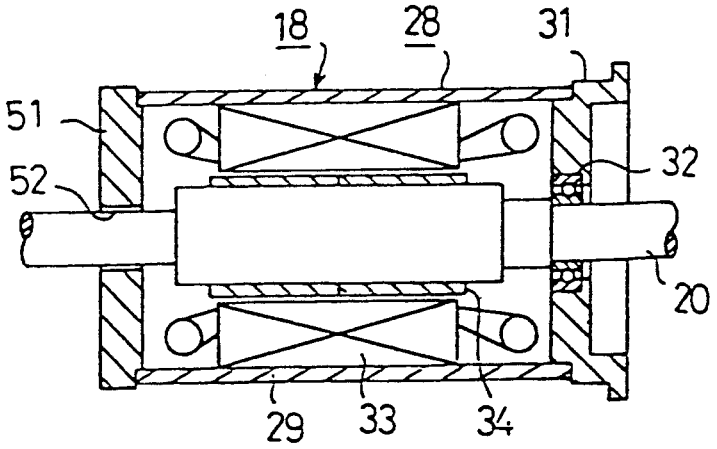
FIG. 5 is a sectional view of the motor according to a third preferred embodiment of the invention.

FIG. 5 shows a third embodiment of the invention in which a bracket 51 is also provided on the left end of the housing 28 of the motor 18. The bracket 51 is formed with the through-hole 52 through which the motor shaft 20 passes similar to the second embodiment. However, the annular spacing between the through-hole 52 and the motor shaft 20 is set at 0.5 mm or less, so as to minimize the deflection of the motor shaft 20 so that the rotor 34 does not contact the stator 33 when connecting the motor shaft 20 to the upper shaft 9. Accordingly, the left end portion of the motor shaft 20 can be easily inserted into the coupling 21 fixed on the upper shaft 9.

Figure 6:
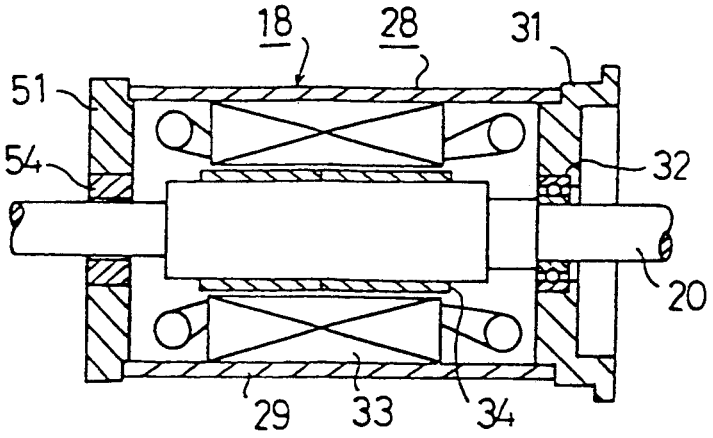
FIG. 6 is a sectional view of the motor according to a fourth preferred embodiment of the invention.

FIG. 6 shows a fourth embodiment of the invention, in which a bearing metal 54 is provided in the bracket 51 mounted to the left end of the housing 28 of the motor 18. The bearing metal 54 is formed with a central hole through which the motor shaft 20 is inserted. An annular spacing between the central hole of the bearing metal 54 and the motor shaft 20 is set at about 5–20 microns. Prior to assembly of the motor 18 to the machine frame 1, a characteristic test of the motor 18 can be carried out with the motor shaft 20 supported by the bearing metal 54 and the ball bearing 32. After assembling the motor 18 to the machine frame 1, the bearing metal 54 does not function as a bearing.

Figure 7:
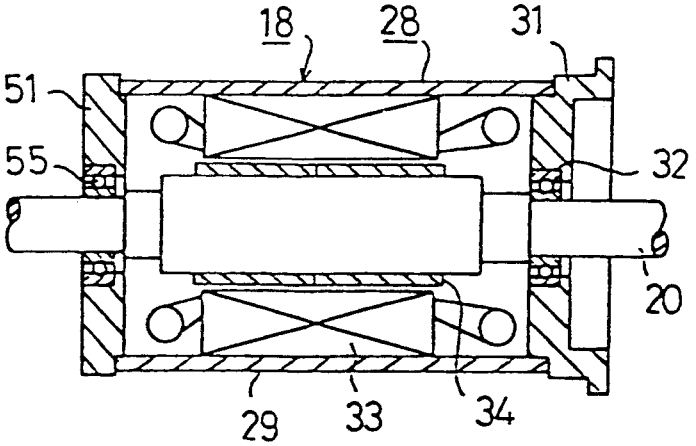
FIG. 7 is a sectional view of the motor according to a fifth preferred embodiment of the invention.

FIG. 7 shows a fifth embodiment of the present invention. In this fifth embodiment, a ball bearing 55 is removably mounted in the bracket 51 mounted to the left end of the housing 28 of the motor 18. The left portion of the motor shaft 20 is supported by the ball bearing 55. Prior to assembly of the motor 18 to the machine frame 1, a characteristic test of the motor 18 can be carried out with the motor shaft 20 supported by the ball bearings 55 and 32. At the time when the motor 18 is assembled to the machine frame 1, the ball bearing 55 is removed from the bracket 51.

It is to be noted that the present invention is not limited to the above preferred embodiments. For instance, the present invention may be applied to a sewing machine wherein the motor 18 is provided in opposed relationship to an end of the lower shaft 14, as the main shaft of the sewing machine, and the motor shaft 20 is connected to the lower shaft 14 by the coupling 21.

We claim:

1. A sewing machine comprising:

a machine frame;

a main shaft rotatably mounted in said machine frame;

a motor mounted in said machine frame in an opposed relationship to an end of said main shaft for driving said sewing machine, said motor having a motor shaft and a housing;

a coupling for connecting said main shaft with said motor shaft, said coupling seated in a first bearing mounted in said machine frame; and a second bearing for supporting said motor shaft to said housing provided on an opposite side of said motor than said coupling.

2. The sewing machine as defined in claim 1, wherein on an opposite side of said motor with respect to said bearing, said housing is formed with a through-hole for passing therethrough an end of said motor shaft for connecting with said main shaft by means of said coupling.

3. The sewing machine as defined in claim 1, further comprising a member for preventing intrusion of a lubricating oil into said housing, said member being provided between an inner opening edge of said through-hole and said motor shaft.

4. The sewing machine as defined in claim 1, wherein said housing is provided with a bearing metal for temporarily supporting said motor shaft on an opposite side of said motor with respect to said second bearing.

5. The sewing machine as defined in claim 1, wherein said housing is removably provided with another bearing for temporarily supporting said motor shaft on an opposite side of said motor with respect to said second bearing.

6. A sewing machine comprising:

a machine frame;

a main shaft rotatably provided in said machine frame;

a motor provided in said machine frame in an opposed relationship to an end of said main shaft for driving said sewing machine, said motor having a motor shaft, a rotor mounted on said motor shaft, and a housing;

a first bearing mounted within said machine frame for supporting said motor shaft;

a coupling for connecting said main shaft with said motor shaft; and a second bearing provided on an opposite side of said rotor than said coupling for supporting said motor shaft in said housing.

7. A built-in drive for a sewing machine having a sewing machine body, comprising:

a motor mounted in said sewing machine body by means of a cylindrical housing, a motor shaft extending through said cylindrical housing, said motor shaft supported at one end in a first bearing mounted in an end bracket of said cylindrical housing;

a coupling mounted on an other end of said motor shaft;

a main shaft having an end mounted in said coupling to oppose said other end of said motor shaft, said coupling being seated in a second bearing mounted in said sewing machine body.

8. A built-in drive as claimed in claim 7, wherein said cylindrical housing further comprises a second bracket, said other end of said motor shaft passing through an annular opening in said second bracket.

9. A built-in drive as claimed in claim 8, further comprising a packing member provided between an inner edge of said annular opening in said second bracket and said motor shaft to prevent lubricating oil intruding into said cylindrical housing.

10. A built-in drive as claimed in claim 8, wherein said annular opening defines a bearing metal for temporarily supporting said motor shaft.

11. A built-in drive as claimed in claim 8, wherein said annular opening defines a third bearing, said third bearing being removable.

12. The sewing machine as claimed in claim 6, wherein said first bearing is mounted outside of said housing.

13. The sewing machine as claimed in claim 12, wherein said coupling is seated in said first bearing.

14. The sewing machine as claimed in claim 1, wherein said motor further comprises a rotor mounted on said motor shaft and said second bearing is provided on an opposite side of said rotor than said coupling.

* * * * *